US010098818B2

(12) United States Patent
Riley et al.

(10) Patent No.: US 10,098,818 B2
(45) Date of Patent: Oct. 16, 2018

(54) CUSPIDOR FUNNELS ATTACHABLE TO EMPTY DRINK CONTAINERS

(71) Applicants: Chad Riley, Shiner, TX (US); Marvin Boedeker, Shiner, TX (US)

(72) Inventors: Chad Riley, Shiner, TX (US); Marvin Boedeker, Shiner, TX (US)

(73) Assignee: Spitit, LLC, Shiner, TX (US)

( * ) Notice: Subject to any disclaimer, the term of this patent is extended or adjusted under 35 U.S.C. 154(b) by 0 days.

(21) Appl. No.: 15/345,304

(22) Filed: Nov. 7, 2016

(65) Prior Publication Data

US 2017/0128327 A1 May 11, 2017

Related U.S. Application Data

(60) Provisional application No. 62/252,344, filed on Nov. 6, 2015.

(51) Int. Cl.
*A61J 19/00* (2006.01)

(52) U.S. Cl.
CPC ..... *A61J 19/00* (2013.01)

(58) Field of Classification Search
CPC ..... A61J 19/00; B67D 11/00; B67D 11/02; B65B 39/00
USPC ..... 4/258; 141/331, 340, 333
See application file for complete search history.

(56) References Cited

U.S. PATENT DOCUMENTS 2,126,701 A * 8/1938 Hamilton ..... A61J 19/06 4/258
2,218,002 A * 10/1940 Hamilton ..... A61J 19/06 229/5.5
3,798,682 A 3/1974 Harreld
4,162,547 A 7/1979 Jenkins
4,503,572 A * 3/1985 Dawson ..... A61J 19/00 220/521
4,858,250 A 8/1989 Lee
4,885,809 A 12/1989 Muchmore
4,908,882 A 3/1990 Williams et al.
4,949,405 A * 8/1990 Johnson ..... A61J 19/00 4/258
5,031,264 A * 7/1991 Muster ..... B65D 17/165 15/104.93
5,325,546 A 7/1994 Setliff
5,396,664 A * 3/1995 King, Jr. ..... A61J 19/00 4/259
5,762,120 A * 6/1998 Smith ..... B67C 11/02 141/331

(Continued)

*Primary Examiner* — Benjamin R Shaw

(74) *Attorney, Agent, or Firm* — Kammer Browning PLLC

(57) ABSTRACT

Two embodiments of a cuspidor funnel are described, each of which may be securely attached to an empty beverage container, and then detached from the container with the container being disposed of after use. A first is attached to a standard sized beverage can while the second is structured to be attached to a standard sized beverage bottle. The can embodiment includes a cylindrical structure that snaps onto the beverage can top rim and positions a funnel neck into the opening of the beverage can typical of a press-tab opening soda or beer can. This funnel neck receives fluid captured by the angled funnel wall formed on the top face of the cuspidor funnel. The beverage bottle embodiment includes a generally cylindrical structure that is threaded onto the beverage bottle opening typical of most single serving plastic beverage bottle containers.

8 Claims, 8 Drawing Sheets

(A - A')

(56) References Cited

U.S. PATENT DOCUMENTS

| | | | | |
|---|---|---|---|---|
| 5,832,543 | A | 11/1998 | Bosserman | |
| 5,927,353 | A * | 7/1999 | Persson | B65B 39/00 141/331 |
| 6,266,829 | B1 | 7/2001 | Schmidt | |
| 6,305,033 | B1 | 10/2001 | Azzam | |
| 6,425,424 | B1 * | 7/2002 | Ellis Calvo | B65B 39/00 141/331 |
| 6,665,887 | B2 | 12/2003 | Nguyen | |
| 6,718,563 | B1 | 4/2004 | Kreiensieck | |
| 6,901,976 | B1 * | 6/2005 | Bautista | A61J 19/02 141/333 |
| D691,767 | S | 10/2013 | Mills | |
| 2002/0020008 | A1 | 2/2002 | Nguyen | |
| 2006/0101564 | A1 | 5/2006 | Powdermaker | |
| 2007/0277299 | A1 | 12/2007 | Kroon | |
| 2011/0308667 | A1 * | 12/2011 | Gallegos | B65B 39/00 141/340 |
| 2014/0144547 | A1 * | 5/2014 | Roseman | B67C 11/02 141/340 |
| 2016/0128907 | A1 * | 5/2016 | Bagdasarian | A61J 19/00 4/274 |
| 2016/0184187 | A1 * | 6/2016 | Brown | A61J 19/00 4/267 |

* cited by examiner (A - A′)

(B - B′)

(C - C′)

CUSPIDOR FUNNELS ATTACHABLE TO EMPTY DRINK CONTAINERS

CROSS REFERENCES TO RELATED APPLICATIONS

This application claims the benefit under Title 35 United States Code § 119(e) of U.S. Provisional Patent Application Ser. No. 62/252,344; Filed: Nov. 7, 2015; the full disclosure of which is incorporated herein by reference.

BACKGROUND OF THE INVENTION

1. Field of the Invention

The present invention relates generally to funnels for use with conducting fluids into containers. The present invention relates more specifically to funnels configured to be attachable to standard sized entry drink containers for use as portable hand held cuspidors.

2. Description of the Related Art

Efforts have been made in the past to provide custom funnels for conducting fluids into containers where the fluids may be adequately contained or stored until disposed of. Efforts have also been made in the past to create cuspidors with funnel shaped openings that receive and retain the expelled saliva of an individual using the cuspidor. Such individuals may include, but are not limited to, those that use chewing tobacco or moist snuff (dipping tobacco). Large cuspidors or spittoons with funnel shaped openings have been known for decades. There are, however, very few personal sized cuspidors that function well to receive and retain the expelled saliva of the individual user.

Most individuals that utilize chewing tobacco or dipping tobacco indoors (or in other locations where the saliva may not simply be expelled onto the ground) will attempt to utilize any small container that might be readily available as a cuspidor. In most cases, the containers that are available are empty beverage containers such as the twelve ounce beverage cans or twenty ounce beverage bottle. Unfortunately, the openings on each of these types of beverage containers are relatively small, making it difficult for the user to cleanly expel saliva fully into the container without ending up with at least some saliva on the exterior of the container and/or on the hand of the user.

Personal cuspidors of any size are generally impractical as few users would choose to carry around a container of the size that would be required to make the personal cuspidor useful. It would be much more practical to have a small funnel that may be discretely carried by an individual and then utilized in association with an available empty beverage container of one of the types that is ubiquitous in modern society (namely the beverage can or beverage bottle). Whereas a specifically design personal cuspidor, even if it was of a size suitable for being carried around, would require emptying and cleaning after use, a cuspidor funnel could simply be removed from the beverage container and the container disposed of (recycled).

SUMMARY OF THE INVENTION

The present invention therefore provides two embodiments of a cuspidor funnel that may be securely attached to an empty beverage container so that the container may be used as a personal cuspidor, and then detached from the container with the container being disposed of after use. A first embodiment is structured to be attached to a standard sized twelve ounce beverage can (of the type typically used for soda and/or beer) while the second embodiment is structured to be attached to a standard sized twenty ounce beverage bottle (of the type used for soda and/or bottled water). The beverage can embodiment includes a generally cylindrical structure that snaps onto the beverage can top rim and positions a funnel neck into the oval opening in the beverage can that is typical of a press-top soda or beer can. This funnel neck receives fluid captured by the angled funnel wall formed on the top face of the cuspidor funnel device. The beverage bottle embodiment includes a generally cylindrical structure that is threaded or screwed onto the beverage bottle threaded opening that is typical of most single serving sized plastic beverage bottle containers. The cuspidor funnels are preferably constructed of a molded plastic polymer material that is rigid enough to retain its funnel shape but flexible enough to provide the ability to snap-receive a can rim into a formed channel to secure the structure to the can. While variations in the overall volume of beverage cans and beverage bottles do exist, the vast majority adhere to very specific dimensions for the can top diameters, the push tab openings, the bottle neck diameters, and the bottle neck threading.

DETAILED DESCRIPTION OF THE PREFERRED EMBODIMENTS

Figure 1A:
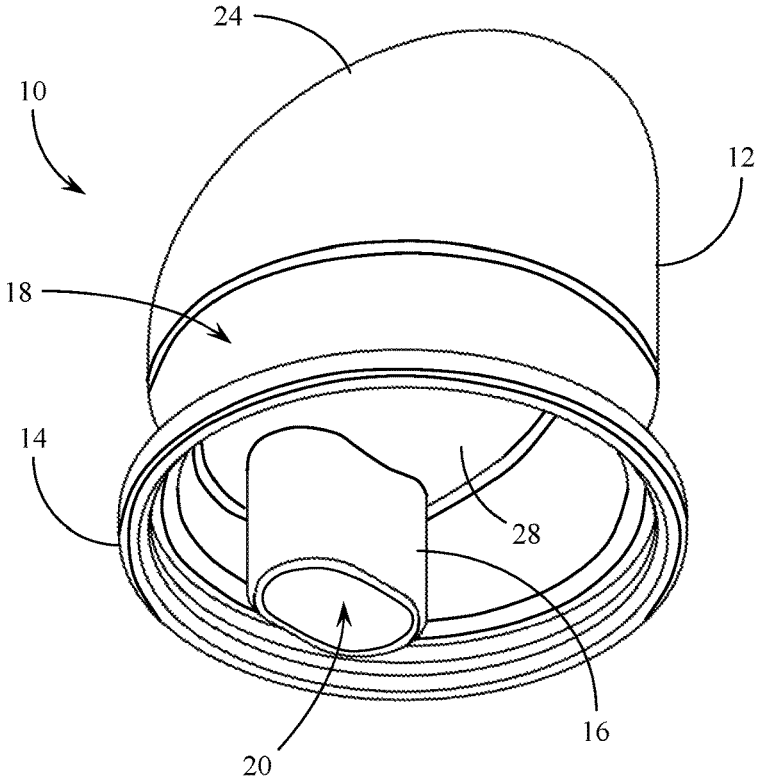
FIGS. 1A & 1B are perspective views of a first cuspidor funnel embodiment of the present invention attachable to an empty beverage can.
Figure 1B:
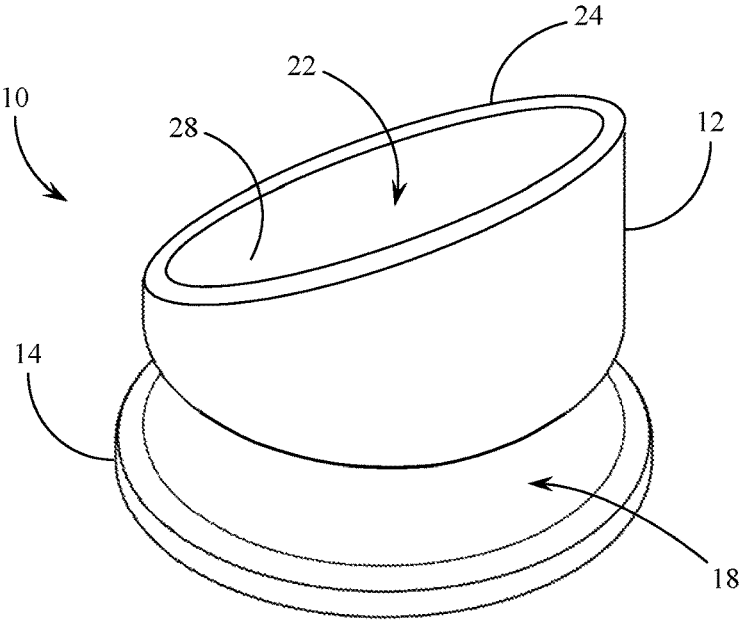

Reference made first to FIGS. 1A & 1B; 2A-2C; and 3A & 3B for a description of the first preferred embodiment of the present invention structured for attachment to an empty beverage can container. FIGS. 1A & 1B are perspective views of the first cuspidor funnel embodiment of the present invention, showing the manner in which the device is attachable to an empty beverage can. FIG. 1A is a perspective view of the cuspidor funnel from below the funnel opening showing the structures that direct fluid flow into the empty beverage can. FIG. 1B is a perspective view from above the funnel showing the manner in which it would be positioned and secured on top of an empty beverage can container.

In FIGS. 1A & 1B, can cuspidor funnel 10 is shown to be generally constructed of funnel cylinder 12 with connection cylinder 14 attachable to the beverage can (not shown in this view). Funnel neck 16 (seen only in FIG. 1A) extends from the funnel opening through the cuspidor funnel structure to the generally oval shaped opening of the typical press tab beverage can lid. A grip channel 18 is formed between funnel cylinder 12 and connection cylinder 14 that facilitates the attachment and removal of the funnel to and from the empty beverage can. The manner in which can cuspidor funnel 10 is attached to a beverage can is shown and described in more detail below with respect to FIG. 7.

Can cuspidor funnel 10 defines an upper funnel opening 22 and a lower funnel throat 20. It is through these structures that fluid, such as the saliva of the individual using the cuspidor, flows from outside the beverage container to the inside where it may be adequately retained. Funnel opening 22 is defined by funnel rim 24 and funnel wall 28 which, in the preferred embodiment, establish a generally circular funnel with an angled opening that allows the user to implement either the lower rim edge of the funnel or the raised rim edge of the funnel in order to dispose saliva into the cuspidor. In other words, the user may orient the funnel positioned on top of the empty beverage can so as to direct saliva over either the lower edge of the funnel (to the left as seen in FIG. 1B) or the raised edge of the funnel (to the right as seen in FIG. 1B).

The structure of can cuspidor funnel 10 as shown in FIGS. 1A & 1B is preferably manufactured from an injection molded polymer plastic material having sufficient rigidity to maintain the general structure of the device, but with sufficient flexibility to permit snap on attachment of connector cylinder 14 to the rimmed edge of the typical empty beverage can container. Various polymer plastic materials known in the industry are suitable for this molded construction.

Figure 2A:
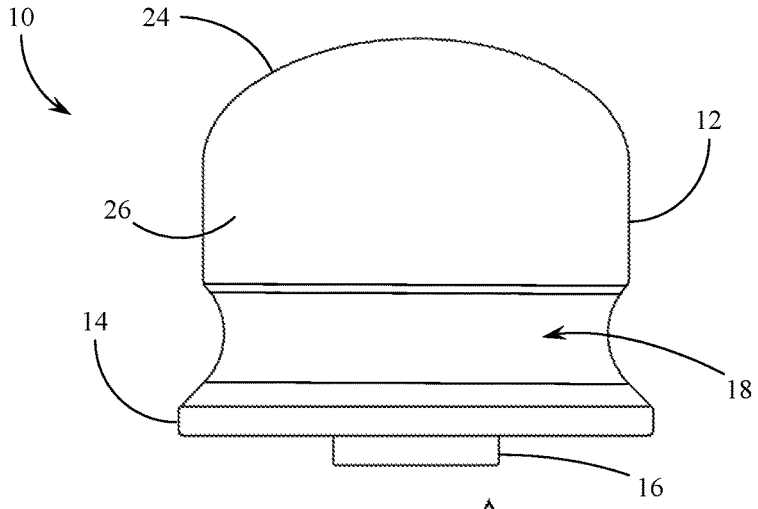
FIG. 2A is a front elevational view of the first (beverage can) cuspidor funnel embodiment of the present invention.
Figure 2B:
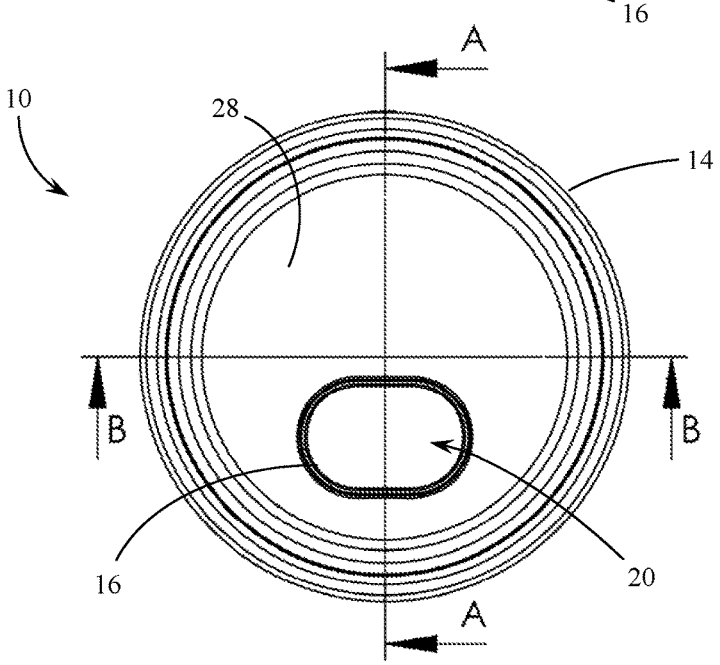
FIG. 2B is a top plan view of the first (beverage can) cuspidor funnel embodiment of the present invention.
Figure 2C:
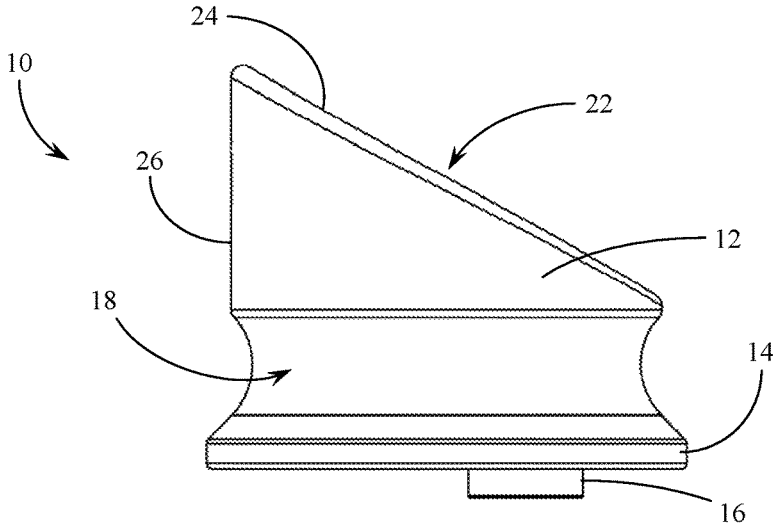
FIG. 2C is a side elevational view of the first (beverage can) cuspidor funnel embodiment of the present invention.

Reference is next made to FIGS. 2A-2C which show in greater detail the various structural elements of can cuspidor funnel 10. FIG. 2A is an elevational front view of the beverage can cuspidor funnel showing the raised edge of funnel rim 24 extending towards the viewer in this orientation. Cylinder wall 26 forms the outer surface of the funnel cylinder 12. Below cylinder wall 26 is grip channel 18 formed between funnel cylinder 12 and connection cylinder 14. Grip channel 18 is sized to accommodate the fingers of the hand of the user such that the user may easily snap the cuspidor funnel onto the top rim of the typical beverage can and/or remove the cuspidor funnel from the lid after use. In the view of FIG. 2A, funnel neck 16 is shown to extend slightly below the lower edge of connection cylinder 14 in a manner that allows it to be partially inserted into the similarly shaped oval opening of the typical press tab opening of the beverage container. In this manner, little or no fluid flows from the funnel onto the top of the beverage container, flowing instead directly into the container, where it is adequately contained even if the container is not held fully upright.

Figure 3A:
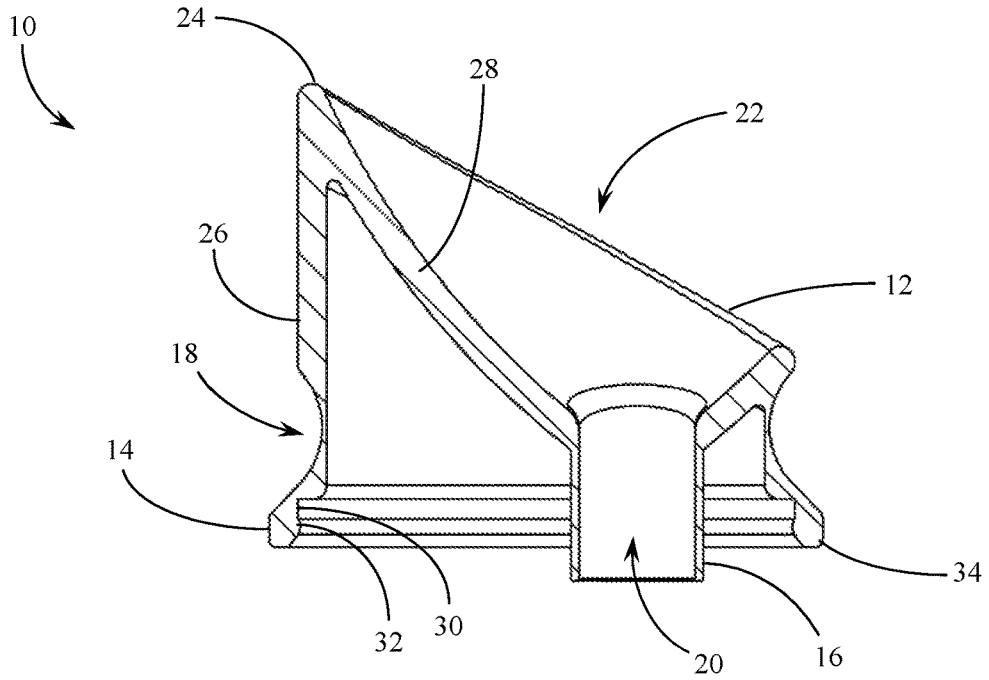
FIG. 3A is a detailed cross-sectional view of the first (beverage can) cuspidor funnel embodiment of the present invention, taken along section line A-A' in FIG. 2B.
Figure 3B:
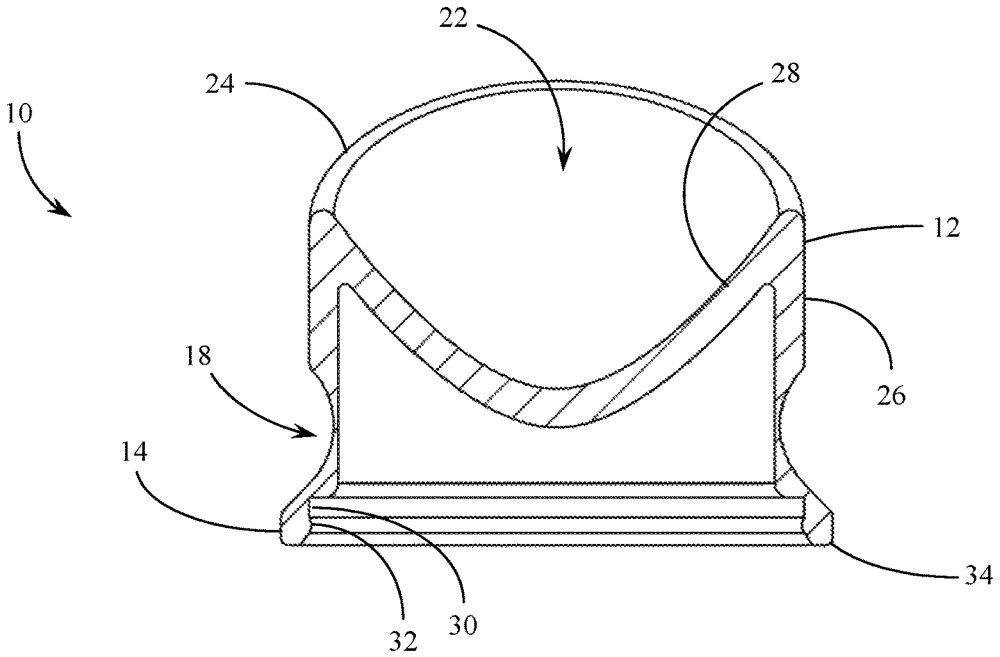
FIG. 3B is a detailed cross-sectional view of the first (beverage can) cuspidor funnel embodiment of the present invention, taken along section line B-B' in FIG. 2B.

FIG. 2B is a top plan view of can cuspidor funnel 10 showing again the funnel throat 20 and its oval shape that generally matches the oval shape of the beverage can opening. Funnel neck 16 is sized to just insert within the standard can opening with little clearance on its perimeter for any leakage to occur. The cross-sectional views of FIGS. 3A & 3B are placed and positioned by the section lines shown in FIG. 2B. Otherwise, the dimensions of connection cylinder 14 are such as to provide the appropriate diameter rim channel that securely snaps onto the raised rim edge of the beverage container. Funnel throat 20, as defined by funnel neck 16, is seen to be offset from a central axis of the circular cylindrical structure of cuspidor funnel 10. This placement aligns funnel neck 16 with the generally standard off-center position of the typical push tab opening in most beverage can tops. The raised and lowered portions of funnel wall 28 are correspondingly oriented to facilitate the various funnel access preferences of the user, as described herein.

FIG. 2C again discloses the manner in which the upper funnel rim 24 is angled so as to present a raised side and a lowered side to allow the user various approaches for utilizing the cuspidor for its intended purpose. Some individuals may prefer to dispose saliva onto the raised edge (left side of the diagram in FIG. 2C) while others may prefer to spit the saliva over the lower edge of funnel rim 34 (the right side of the diagram in FIG. 2C). In either case, the saliva or fluid is channeled by the tapering funnel wall 28 into funnel throat 20 by way of funnel neck 16 through the opening of the beverage can into the interior of the container.

FIG. 3A is a cross-sectional view of can cuspidor funnel 10 taken along section line A-A' of FIG. 2B. In this view, the overall interior shape of the funnel is disclosed with funnel wall 28 being generally large on one side of funnel throat 20 and small on the opposing side. This cross-sectional view further discloses the manner in which cylinder wall 26 surrounds and supports funnel wall 28 and defines an empty volume between the two components that in use simply sits above the top of the beverage container, closed off from external access. The manner in which funnel neck 16 extends below funnel wall 28 and down past the position of the beverage can top into the interior of the beverage can is also seen in FIG. 3A.

Further shown in FIG. 3A is a cross-sectional view of the manner in which connection cylinder 14 is structured to snap onto the typical raised edge rim of a beverage can container. In cross-section, connection cylinder 14 is shown to include can rim groove 30 positioned inside of connection cylinder rim 32. The external edge of connection cylinder 14 is defined by connection cylinder perimeter edge 34. With these structures, also seen in FIG. 3B, the edge of the typical beverage can top may snap into can rim groove 30 after passing connection cylinder rim 32 and thereby tightly secure cuspidor funnel 10 onto the top of the beverage can until it is intentionally removed by the user. Again, grip channel 18 facilitates user attachment of the funnel to the top of the can, as well as its subsequent removal.

FIG. 3B is a cross-sectional view of cuspidor funnel 10 taken along section line B-B' in FIG. 2B and discloses the raised portion of funnel opening 22 with funnel wall 28 and funnel rim 24 shown extending from the lower side of the funnel looking toward the upper side of the funnel. Again, the manner in which cylinder wall 26 surrounds and supports funnel wall 28 to define an interior empty space is shown. In addition, the structure of connection cylinder perimeter edge 34 defining the outer perimeter of connection cylinder 14 as well as the interior can rim groove 30 with connection cylinder rim 32 positioned below, are clearly seen in FIG. 3B.

Figure 7:
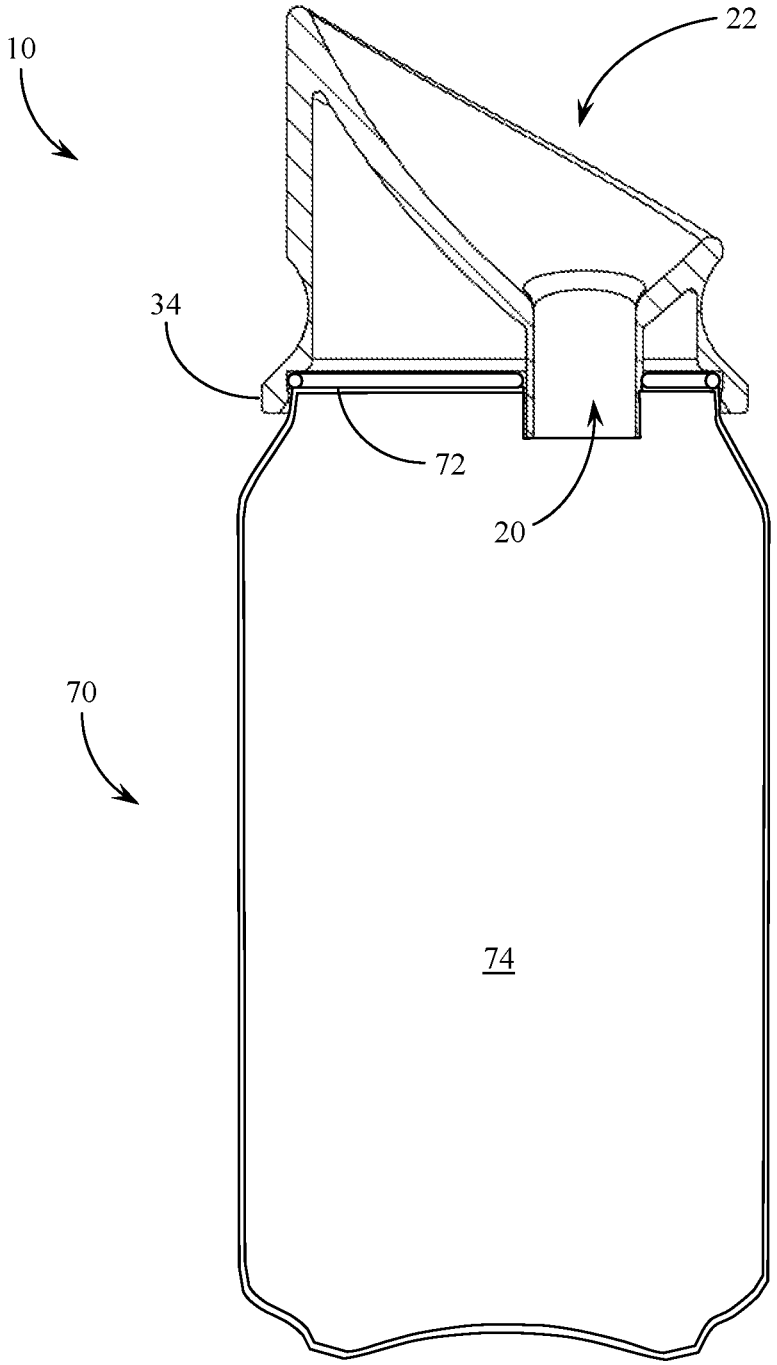
FIG. 7 is cross-sectional view of the first (beverage can) cuspidor funnel of the present invention shown attached to a typical empty beverage can.

Reference is next made to FIG. 7 which is a cross-sectional view of the first (beverage can) cuspidor funnel embodiment of the present invention shown attached to a typical empty beverage can. In this view, can cuspidor funnel 10 is shown attached to empty beverage can 70 as would be typically secured and oriented for use. As described above, funnel throat 20 extends into beverage can interior volume 74 so as to dispense fluids into the empty volume without allowing them to leak onto the top of the beverage can between the cuspidor funnel and the can. The structures of connection cylinder perimeter edge 34 and the interior structures now mostly hidden by beverage can rim bead 72 are also disclosed in FIG. 7. Cuspidor funnel 10 has been snapped into place such that beverage can rim bead 72 is seated within can rim groove 30 (not seen in this view) and secured by connection cylinder rime 32.

As can be seen in the cross-sectional view of FIG. 7, saliva or other fluid that flows through cuspidor funnel 10 into the interior volume 74 of empty beverage can 70 is generally trapped inside the container, even if the container falls over or is otherwise not positioned in the upright orientation shown. While a very full container would, of course, leak back through funnel throat 20 if the container were tipped on its side, or upside down, the modest quantity of fluid disposed within the can container is such that a horizontal orientation of the can that might be a quarter full of fluid, would not find its way back out through funnel throat 20 to leak out of the container. In practice, however, the user would seldom tip the container more than 45° from the vertical such that even a half full container would experience no leakage or drainage.

Figure 4A:
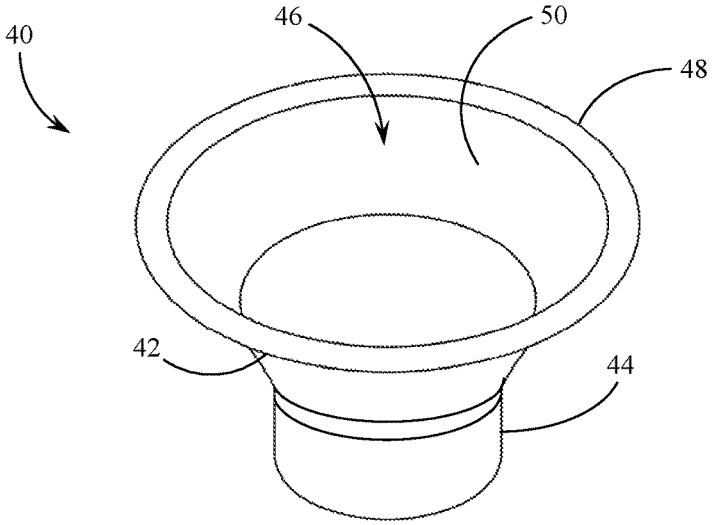
FIGS. 4A-4C are perspective views of a second cuspidor funnel embodiment of the present invention attachable to an empty beverage bottle.
Figure 4B:
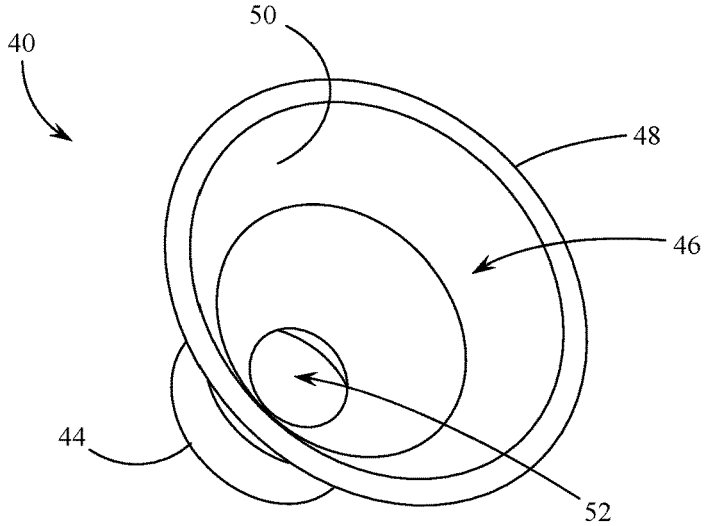
Figure 4C:
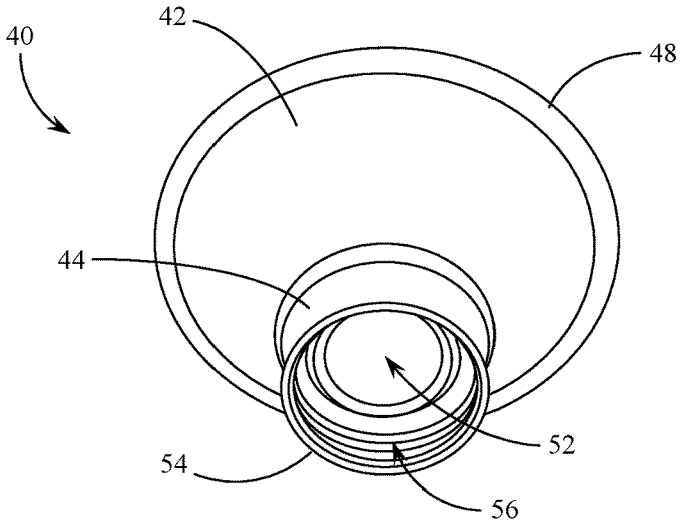
Figure 5A:
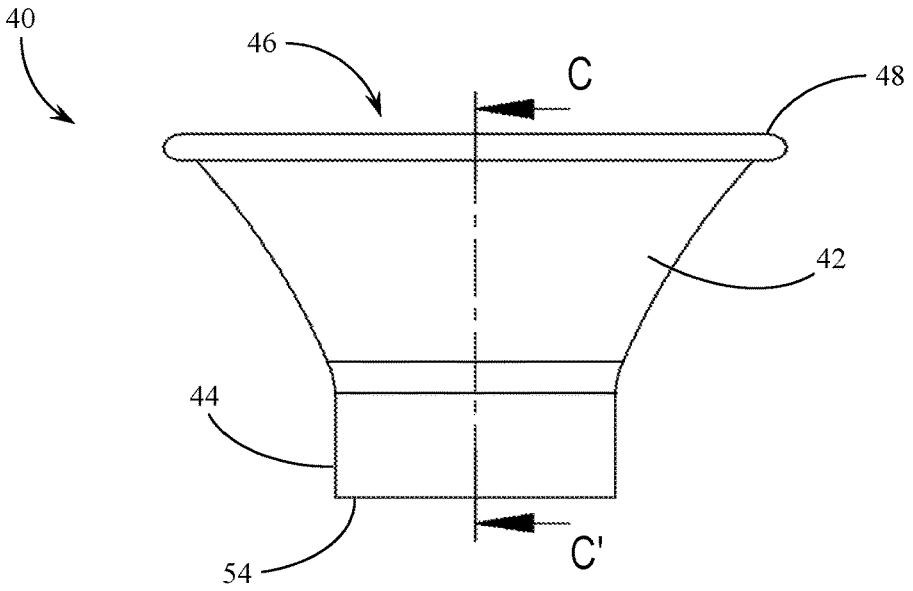
FIG. 5A is a side elevational view of the second (beverage bottle) cuspidor funnel embodiment of the present invention.
Figure 5B:
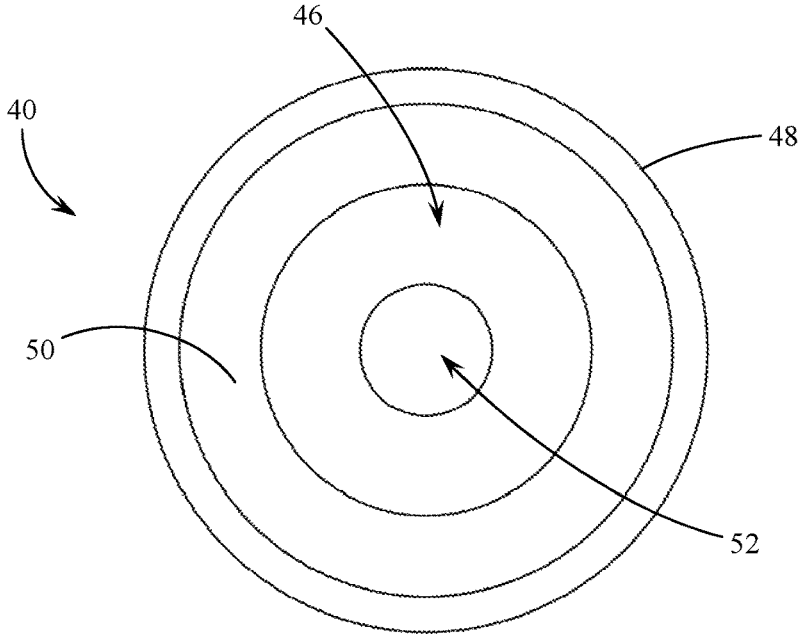
FIG. 5B is a top plan view of the second (beverage bottle) cuspidor funnel embodiment of the present invention.

Reference is next made to FIGS. 4A-4C; FIGS. 5A & 5B; as well as FIGS. 6 & 8, for a description of an alternate preferred embodiment of the present invention suitable for attachment to an empty beverage bottle container. Bottle cuspidor funnel 40 is generally constructed of funnel body 42 and connection cylinder 44. Funnel opening 46 is defined by a generally circular funnel rim 48 with funnel wall 50 as shown. Because the exit opening of the funnel is generally centered within the device, the edges of funnel body 42 are radially symmetrical. In other words, there is less need for a raised or lowered edge to the funnel to provide appropriate access to the container opening, centered as it is with a bottle, while offset as it is with a can. The view shown in FIG. 4B discloses not only the generally circular funnel rim 48 providing the upper edge of funnel wall 50, but also the generally circular lower opening of the funnel throat 52. To the extent shown in FIGS. 4A & 4B, the structure of bottle cuspidor funnel 40 is generally that of standard, radially symmetrical, fluid flow funnels.

It is in FIG. 4C where the unique elements of bottle cuspidor funnel 40 are shown. While the exterior of connection cylinder 44 may preferably be a smooth walled surface, the interior of connection cylinder 44, inside of connection cylinder perimeter edge 54, is preferably threaded in the manner shown with connection threading 56. Funnel throat 52 therefore extends into the bottle neck of the typical beverage container bottle after connection cylinder 44 has been threaded onto the top of the bottle in place of the beverage bottle's standard threaded cap.

FIG. 5A is an elevational side view of the beverage bottle cuspidor funnel of the present invention showing its basic geometry similar in some respects to a standard funnel. FIG. 5B likewise shows basic funnel structures not very different from the typical funnel that might be removeably set into the neck of a bottle without attachment.

Figure 6:
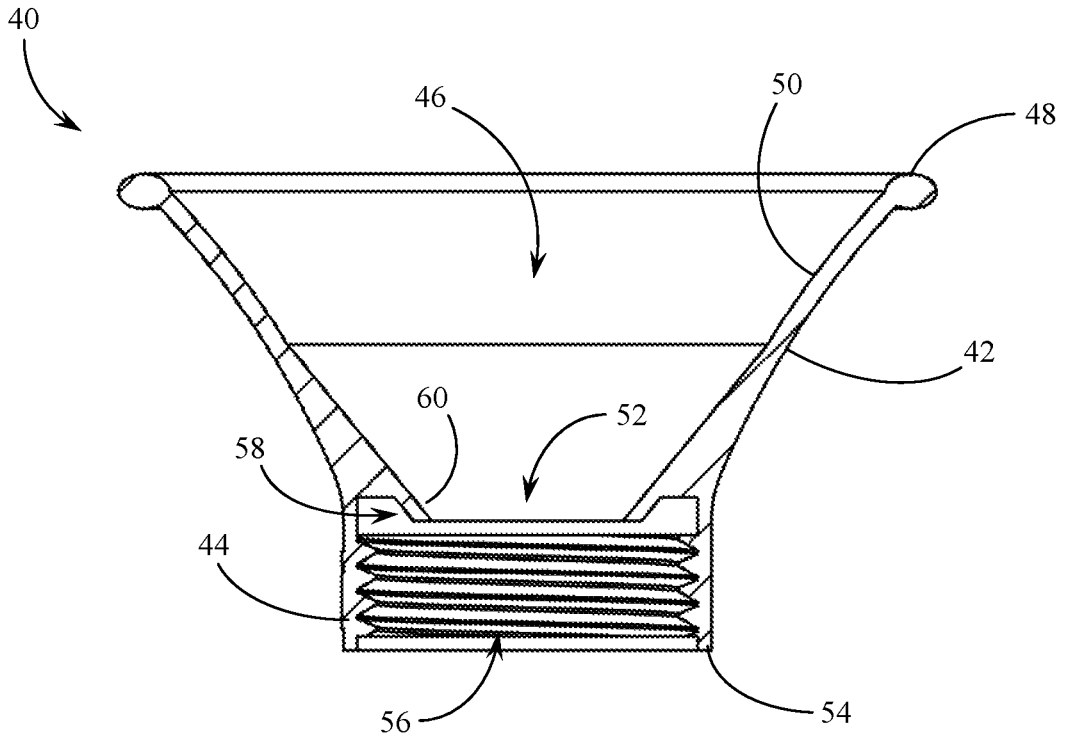
FIG. 6 is a detailed cross-sectional view of the second (beverage bottle) cuspidor funnel embodiment of the present invention taken along section line C-C' in FIG. 5A.

The unique features of bottle cuspidor funnel 40 are seen best in FIG. 6, which is a cross-sectional view taken along section line C-C' of FIG. 5A. In FIG. 6, bottle cuspidor funnel 40 is again shown to be constructed of funnel body 42 and connection cylinder 44. Funnel opening 46 is defined by funnel rim 48 and funnel wall 50. These structures reduce down to funnel throat 52 which is sized to be positioned directly onto and over the bottle neck of the beverage container. Connection cylinder 44 is structured with connection cylinder perimeter edge 54 and internal connection threading 56. At the internal end of threading 54 is connection seat 58 designed to receive the upper perimeter edge of the bottle neck opening. In order to direct fluid from funnel opening 46 through funnel throat 52 and into the empty beverage container without leakage, funnel neck overlap 60 is provided so as to prevent fluids from passing around the threaded portions of the attachment structures.

Figure 8:
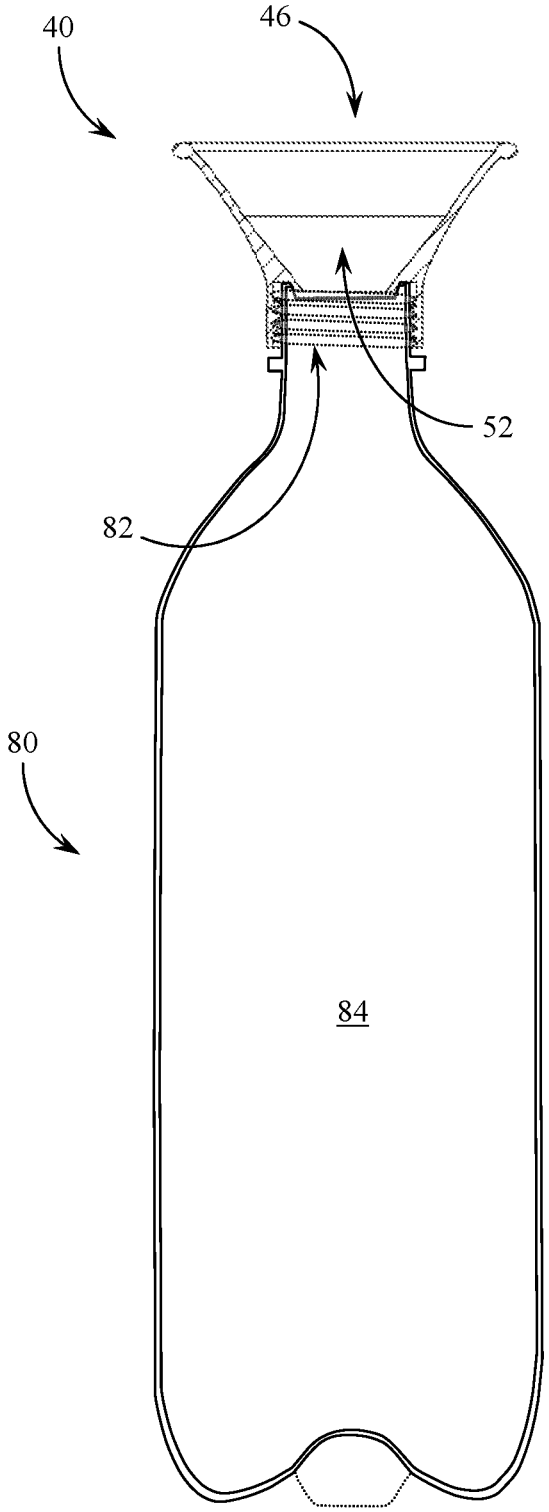
FIG. 8 is cross-sectional view of the second (beverage can) cuspidor funnel of the present invention shown attached to a typical empty beverage bottle.

Reference is finally made to FIG. 8 which is a cross-sectional view of the second preferred embodiment (the beverage bottle cuspidor) of the present invention positioned on the top of a typical beverage bottle. Bottle cuspidor funnel 40 is positioned onto the beverage bottle neck by way of threading 82 in place of the standard bottle cap that is normally threaded onto the bottle neck to close the container. Beverage bottle interior volume 84 is therefore accessible through funnel throat 52 from funnel opening 46. Here again, it is seen how the containment method defined by the use of the attachable cuspidor funnel 40 allows for a modest quantity of fluid to be closed within the container even if the container is tipped on its side in a horizontal orientation. With each of the two embodiments described above, it is anticipated that less than a third of the interior volume of the container would be filled before the user would either dispose of the container or empty it for further use. The primary purpose of each of the two embodiments is to allow for the easy assembly of a portable hand held cuspidor device that the user might easily access for a significant period of time, maintaining the fluids securely within the confines of the bottle or can, before such would require emptying or disposal.

Although the present invention has been described in association with a number of preferred embodiments, those skilled in the art will recognize alternate geometries and structures that would be applicable to alternate container sizes and shapes, without departing from the basic spirit and scope of the invention. While twelve ounce cans and twenty ounce bottles are mentioned as being the typical beverage containers to which the embodiments apply, there is no specific requirement as to the actual volume of the container used. In addition, those skilled in the art will recognize variations in the material from which the cuspidor funnels are constructed and even the manner of construction (molding or milling). Various other formable materials such as resins or even metals may be used for the construction of the preferred embodiments described.

We claim:

1. A cuspidor funnel for attachment to an empty beverage container, the beverage container having a container body, a rolled top rim, and a generally oval shaped top aperture, the cuspidor funnel comprising:

an upper portion comprising a funnel body and a funnel rim, the funnel body defining a generally oval shaped funnel drain with an extended drain wall, the oval shaped funnel drain and extended drain wall having a common central axis; and a lower portion extending from and supporting the upper portion, the lower portion comprising a generally cylindrical support wall and a beverage container attachment collar, the support wall extending from the attachment collar to the funnel rim of the upper portion, the generally cylindrical support wall having a central axis offset from the common central axis of the funnel drain and extended drain wall, the central axis of the support wall and the common central axis of the funnel drain and extended drain wall generally parallel to each other and orthogonal to a plane defined by the attachment collar, the generally cylindrical support wall comprising a truncated cylinder with a first end coplanar with the attachment collar and a second end coplanar with the funnel rim, the second end of the truncated cylinder angled with respect to the first end of the truncated cylinder, giving the truncated cylinder a high side and a low side, the low side of the truncated cylinder oriented proximal to the funnel drain;

wherein the attachment collar of the cuspidor funnel is secured to the beverage container at the rolled top rim thereof and oriented so as to align the oval shaped funnel drain with the generally oval shaped top aperture of the beverage container.

2. The cuspidor funnel of claim 1 wherein the beverage container attachment collar comprises a generally circular edge rim having an internal circular shelf, the internal circular shelf having a diameter generally equal to the diameter of the rolled rim of the beverage can.

3. The cuspidor funnel of claim 1 wherein the upper portion and the lower portion of the funnel are a unitary molded structure of plastic polymer material.

4. The cuspidor funnel of claim 1 further comprising a recessed region in the cylindrical support wall of the lower portion of the cuspidor funnel, the recessed region comprising a generally cylindrical indentation in the cylindrical support wall adjacent to the attachment collar and sized to be gripped by the hand of the user.

5. The cuspidor funnel of claim 1 wherein the drain wall extends from the funnel drain at least partially into the top aperture of the beverage can.

6. The cuspidor funnel of claim 2 wherein the circular edge rim of the attachment collar comprises a collar extension and wherein the rolled rim of the beverage can is pushed past the collar extension into the internal circular shelf to secure the cuspidor funnel to the beverage container.

7. The cuspidor funnel of claim 1 wherein the lower portion forms a generally liquid tight seal with the top rim of the beverage container when secured to the beverage container.

8. The cuspidor funnel of claim 1 wherein at least a portion of the funnel rim extends above the drain wall of the generally oval shaped funnel drain.

* * * * *